US012667160B2

(12) United States Patent
Taylor

(10) Patent No.: US 12,667,160 B2
(45) **Date of Patent: *Jun. 30, 2026**

(54) IMPACT REDUCTION FOOTWEAR THROUGH HEEL AND METATARSAL CAVITIES

(71) Applicant: Romeo & Juliette, Inc., Citrus Heights, CA (US)

(72) Inventor: Craig Taylor, Citrus Heights, CA (US)

(73) Assignee: Romeo & Juliette, Inc., Citrus Heights, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/954,289

(22) Filed: Nov. 20, 2024

(65) Prior Publication Data

US 2025/0072555 A1 Mar. 6, 2025

Related U.S. Application Data

(63) Continuation of application No. 17/407,636, filed on Aug. 20, 2021, now Pat. No. 12,150,514.

(Continued)

(51) Int. Cl.

| | |
|---|---|
| ***A43B 13/04*** | (2006.01) |
| ***A43B 13/02*** | (2022.01) |
| ***A43B 13/18*** | (2006.01) |

(52) U.S. Cl.

CPC ..... *A43B 13/04* (2013.01); *A43B 13/023* (2013.01); *A43B 13/188* (2013.01)

(58) Field of Classification Search

CPC ..... A43B 13/04; A43B 13/023; A43B 13/188; A43B 13/02; A43B 13/187; A43B 17/003;

(Continued)

(56) References Cited

U.S. PATENT DOCUMENTS 4,667,423 A 5/1987 Autry et al.
4,694,591 A 9/1987 Banich et al.

(Continued)

FOREIGN PATENT DOCUMENTS

WO WO-2018190463 A1 * 10/2018 ..... A43B 13/18

OTHER PUBLICATIONS

Taylor, U.S. Appl. No. 17/407,636, filed Aug. 20, 2021, Non-Final Rejection, Mar. 22, 2024.

(Continued)

*Primary Examiner* — Jameson D Collier

(74) *Attorney, Agent, or Firm* — Hickman Becker Bingham Ledesma LLP

(57) ABSTRACT

A three-layered article of footwear construction having an outsole, midsole, and footbed. The outsole is made out of a rubber and has a mating relationship with the midsole. The midsole is made of a single density blown ethylene-vinyl acetate copolymer (EVA). The midsole includes a first air cavity in the forefoot region and a second air cavity in the hind foot. The air cavities act like a suspension units under the impact areas of a foot giving improved impact reduction and help in reducing muscular and joint stress, fatigue, and impact during the normal walking gait motion. The footbed is made of a dual-density EVA. The dual density of the footbed allows for a greater flexibility and cushioning in the forefoot and heel regions due to its lighter density and provides greater support and stability around the perimeter area of the footbed due to its heavier density.

20 Claims, 3 Drawing Sheets

Related U.S. Application Data

(60) Provisional application No. 63/068,348, filed on Aug. 20, 2020.

(58) Field of Classification Search
CPC ..... A43B 17/006; A43B 17/14; A43B 7/14; A43B 7/1405; A43B 7/1425; A43B 7/145; A43B 7/1435
See application file for complete search history.

(56) References Cited

U.S. PATENT DOCUMENTS

| | | | | |
|---|---|---|---|---|
| 4,730,402 | A * | 3/1988 | Norton | A43B 13/12 36/114 |
| 6,038,790 | A * | 3/2000 | Pyle | A43B 7/144 36/28 |
| 7,426,792 | B2 | 9/2008 | Swigart et al. | |
| 7,685,744 | B2 | 3/2010 | Lundy, Jr. et al. | |
| 7,793,430 | B2 * | 9/2010 | Ellis | A43B 13/188 36/142 |
| 7,941,938 | B2 | 5/2011 | Yu et al. | |
| 9,289,028 | B1 | 3/2016 | Anderson | |
| 9,693,603 | B2 * | 7/2017 | Ellis | A43B 13/14 |
| 10,849,387 | B2 * | 12/2020 | Bruce | A43B 7/1445 |
| 12,150,514 | B2 * | 11/2024 | Taylor | A43B 7/144 |
| 2002/0007569 | A1 | 1/2002 | Crane et al. | |
| 2003/0070321 | A1 | 4/2003 | Davis et al. | |
| 2005/0160626 | A1 * | 7/2005 | Townsend | A43B 13/188 36/28 |
| 2006/0021251 | A1 | 2/2006 | Swigart et al. | |
| 2007/0033834 | A1 | 2/2007 | Cheskin et al. | |
| 2010/0287795 | A1 | 11/2010 | Van Niekerk | |
| 2011/0113649 | A1 | 5/2011 | Merritt et al. | |
| 2011/0214310 | A1 | 9/2011 | Rosenbaum | |
| 2014/0259779 | A1 | 9/2014 | Hashish et al. | |
| 2020/0029652 | A1 | 1/2020 | Wert | |
| 2022/0053880 | A1 | 2/2022 | Taylor | |

OTHER PUBLICATIONS

Taylor, U.S. Appl. No. 17/407,636, filed Aug. 20, 2021, Final Rejection, Jul. 27, 2023.

Taylor, U.S. Appl. No. 17/407,636, filed Aug. 20, 2021, Non-Final Rejection, Aug. 17, 2022.

* cited by examiner

IMPACT REDUCTION FOOTWEAR THROUGH HEEL AND METATARSAL CAVITIES

RELATED APPLICATION DATA AND CLAIM OF PRIORITY

This application is a continuation of prior U.S. patent application Ser. No. 17/407,636 entitled "IMPACT REDUCTION FOOTWEAR THROUGH HEEL AND METATARSAL CAVITIES," filed Aug. 20, 2021, the contents of which are incorporated by reference for all purposes as if fully set forth herein, which claims the benefit of U.S. Provisional Application No. 63/068,348 entitled "IMPACT REDUCTION FOOTWEAR THROUGH HEEL AND METATARSAL CAVITIES," filed Aug. 20, 2020, the contents of which are incorporated by reference for all purposes as if fully set forth herein.

FIELD OF THE INVENTION

The present invention relates generally to footwear, and in particular an article of footwear with heel and metatarsal cavities for impact reduction.

BACKGROUND

Numerous shoes, covering a broad range of different designs and styles have been manufactured and sold in the marketplace. While shoes are worn to provide protection to one's feet, to reduce the impact felt when walking on hard surfaces, to provide support for the feet, and to prevent pronation, shoe designers must still seek to provide optimum levels of stability and comfort.

In order to accomplish all of these objectives, shoe designers have used a wide variety of different tools and methods including heel plugs, shanks, contoured soles, deformable pillars or columns, spring-like structures, different traction designs, cushioning members, different shank designs, different ventilation structures, rocker elements, pads, gels, and sole constructions having a plurality of different layers.

Although some these methods can be somewhat effective, techniques are desired to further improve impact reduction and help in reducing muscular and joint stress, fatigue, and impact during the normal walking gait motion.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Further, it should not be assumed that any of the approaches described in this section are well-understood, routine, or conventional merely by virtue of their inclusion in this section.

DETAILED DESCRIPTION

Figure 1:
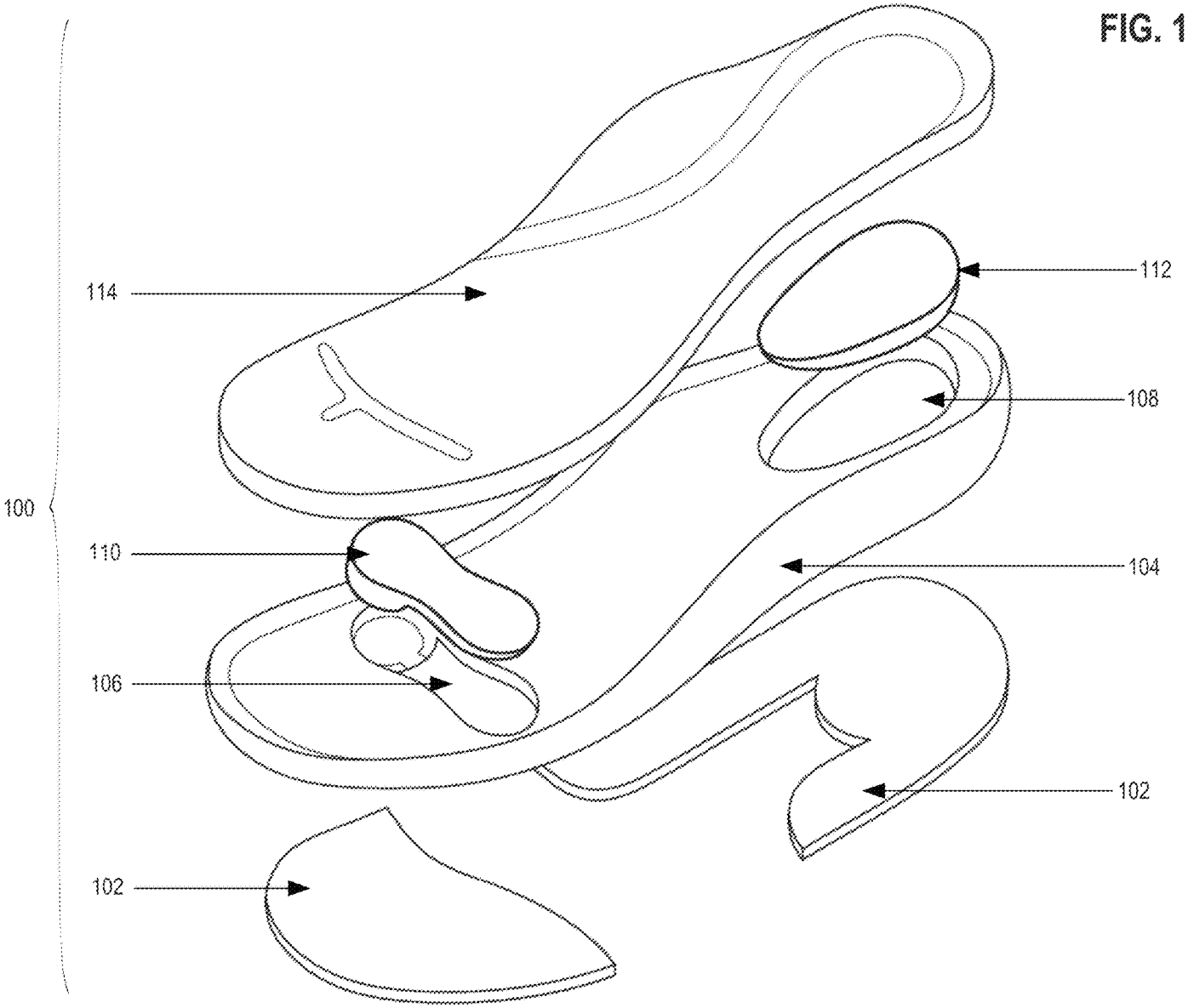
FIG. 1 illustrates a perspective view of an article of footwear constructed in accordance with the teachings of the present invention.

In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

General Overview

The present invention is directed to an article of footwear construction which includes an outsole, midsole, and footbed. The three components of the article of footwear are preferably secured together through conventional means such as through cementing and/or adhesives thereby preventing relative movement between the layers during assembly and use of the article of footwear. Each of the three layers of the article of footwear are generally in the shape of a human foot and can be divided into different sections according to the three different regions of the human foot—the forefoot, the midfoot, and the hind foot. The forefoot is generally adjacent to and includes the toe area; the hind foot is generally adjacent to and includes the heel area; and the midfoot is located adjacent to both the forefoot and the hind foot. The ball of the foot is generally the area of the foot at the juncture between the metatarsal bones and the phalange bones. The two primary regions of the foot for load bearing when walking or standing normally are the ball area and the heel area, and the major bending of the shoe during normal use is typically in the ball area.

The outsole is made out of a rubber, such as for example, a super lightweight thermoplastic rubber (TPR) and includes an exterior and interior face. The exterior face of the outsole engages the ground or other walking surfaces, while the interior face is located opposite the exterior face and has a mating relationship with the midsole.

The midsole is made of a single density blown ethylene-vinyl acetate copolymer (EVA). The EVA creates a lightweight and resilient midsole, which helps dissipate shock when walking or running. In addition to the material itself, the single density of the midsole allows for flexibility and cushioning in the forefoot and heel regions due to its lighter density. The midsole includes a proximal and distal face. The distal face of the midsole mates with the outsole. The proximal face of the midsole mates with the footbed. The midsole includes a first air cavity in the forefoot region and a second air cavity in the hind foot region of the proximal face. The first air cavity may include a Poron® cellular urethane foam insert that rests in the first air cavity. These air cavities act like a suspension units under the impact areas of a foot giving improved impact reduction and help in reducing muscular and joint stress, fatigue, and impact during the normal walking gait motion.

The footbed is made of a dual-density EVA. The footbed has a top face and a bottom face, wherein the top face engages with the foot of a wearer and the bottom face is attached to the midsole. In addition to the material itself, the dual density of the footbed allows for a greater flexibility and cushioning in the forefoot and heel regions due to its lighter density and provides greater support and stability around the perimeter area of the footbed due to its heavier density.

The present three layer article of footwear construction enhances comfort and creates a unique trampoline shock absorption effect when placed under pressure of a foot.

DETAILED DESCRIPTION OF THE DRAWINGS

The present invention will now be described with reference to the drawing figures in which like reference numerals refer to like parts throughout the disclosure. For purposes of clarity in illustrating the characteristics of the present invention, proportional relationships of the elements have not necessarily been maintained in the drawing figures.

As illustrated in FIG. 1, an article of footwear 100, constructed in accordance with the teachings of the present invention, includes an outsole, a midsole, and a footbed. The combination of the three layers provides enhanced comfort and creates a unique trampoline shock absorption effect when placed under pressure of a foot. The layers of the present shoe are preferably secured together in a conventional manner such as through cementing and/or adhesives thereby preventing relative movement between the layers during assembly and use of the present shoe.

The outsole 102 is made out of a rubber, such as a super lightweight thermoplastic rubber (TPR) and includes an exterior face (not shown in FIG. 1) and an interior face as shown in FIG. 1. The exterior face of the outsole 102 engages with the ground or other walking surfaces, while the interior face has a mating relationship with the midsole 104. As shown in FIG. 1, outsole 102 includes a hindfoot section and a forefoot section. The hindfoot section of outsole 102 includes a first extension on a first side of the hindfoot section extending forward toward the forefoot section and a second extension on a second side of the hindfoot section extending forward toward the forefoot section, the first extension extending farther forward than the second extension. In the example depicted in FIG. 1, the hindfoot section and the forefoot section are separate and do not connect.

The midsole 104 is made of a single density EVA. In some embodiments, the shore durometer of the midsole is 65. In some embodiments, the shore durometer of the midsole is a range of 45-96. The EVA creates a lightweight and resilient midsole 104, which helps dissipate shock when walking or running. In addition to the material itself, the single density of the midsole 104 allows for flexibility and cushioning in the forefoot and heel regions due to its lighter density. The midsole 104 includes a proximal face as shown in FIG. 1 and distal face (not shown in FIG. 1). The distal face of the midsole 104 mates with the outsole 102. The proximal face of the midsole 104 mates with the footbed 114. The midsole includes a first air cavity 106 in the forefoot region and a second air cavity 108 in the hind foot region of the proximal face. The midsole layer 104 has a longitudinal bisecting axis that divides the midsole layer into a medial half portion and a lateral half portion. As shown in FIG. 1, the first air cavity 106 has a substantially uniform first depth in a first portion on a first side of the air cavity 106 and a substantially uniform second depth in a second portion on a second side of the air cavity 106 that is less than the first depth. The first air cavity 106 is entirely defined by the first and second portions of the first air cavity. The first air cavity 106 may include a Poron® cellular urethane foam insert 110 that rests in the first air cavity 106. As shown in FIG. 1, Poron® cellular urethane foam insert 110 has a substantially uniform first thickness in a first portion on a first side of the Poron® cellular urethane foam insert 110 and a substantially uniform second thickness in a second portion on a second side of the Poron® cellular urethane foam insert 110 that is less than the first thickness, such that the first portion of the Poron® cellular urethane foam insert 110 rests in the first portion of the air cavity 106 and the second portion of the Poron® cellular urethane foam insert 110 rests in the second portion of the air cavity 106. Also, as shown in FIG. 1, the Poron® cellular urethane foam insert 110 is entirely defined by the first and second portions of the Poron® cellular urethane foam insert. The first portion of the first air cavity 106 and the first portion of the Poron® cellular urethane foam insert 110 are entirely disposed within the medial half portion of the midsole layer. The second portion of the first air cavity 106 and the second portion of the Poron® cellular urethane foam insert 110 are present both in the medial half portion of the midsole layer and in the lateral half portion of the midsole layer, such that the second portion of the first air cavity and the second portion of the Poron® cellular urethane foam insert 110 span across the longitudinal bisecting axis of the midsole layer. In some embodiments, the second air cavity 108 may include a Poron® cellular urethane foam insert 112 that rests in the second air cavity 108. The layer of Poron® cellular urethane foam impact reduction material laid into the air cavities creates further impact reduction when a foot strikes the ground. Each of the first air cavity 106 and second air cavity 108 are open air cavities and do not include any encapsulated air, such as an air bag.

The footbed 114 is made of a dual-density lightweight EVA. In some embodiments, the dual-density of the footbed includes durometers of 65 and 35. The footbed 114 has a top face as shown in FIG. 1 and a bottom face (not shown in FIG. 1). The top face engages with the foot of a wearer and the bottom face attached to the midsole 104. In addition to the material itself, the dual density of the footbed 114 allows for a greater flexibility and cushioning in the forefoot and heel regions due to its lighter density and provides greater support and stability around the perimeter area of the footbed due to its heavier density. The dual-density nature of the footbed 114 in discussed in detail with respect to FIG. 2. In some embodiments, footbed 114 includes a leather cover on the top face.

Figure 2:
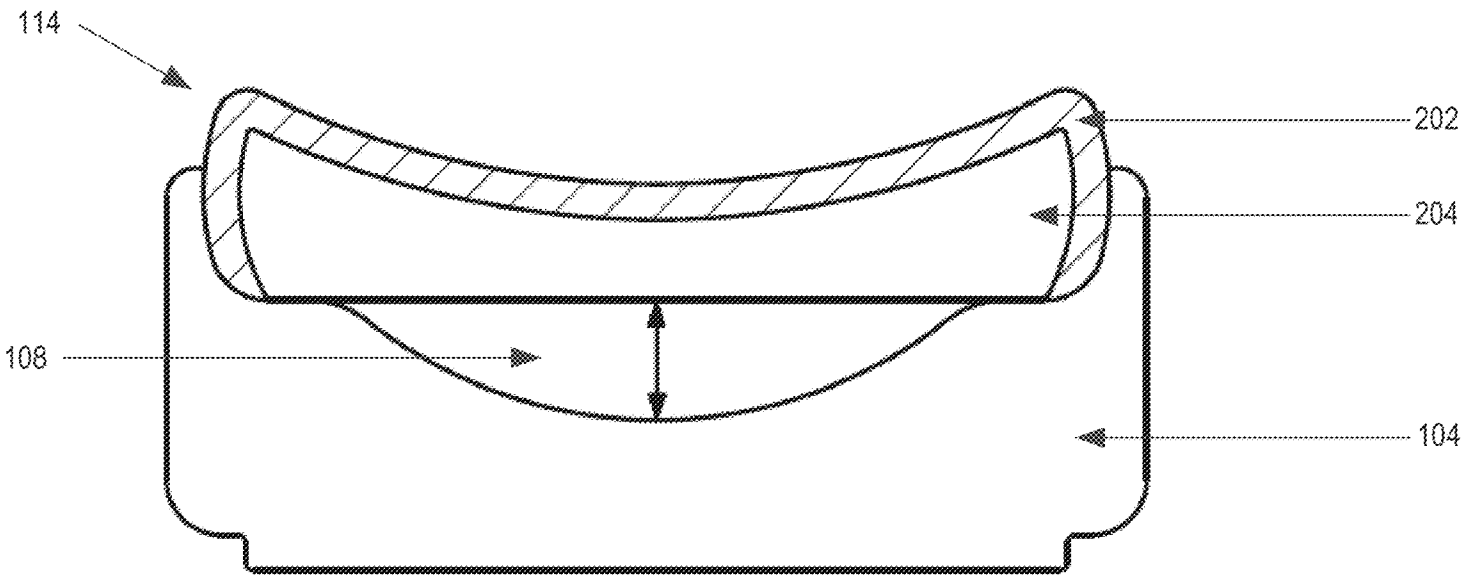
FIG. 2 illustrates a cross-sectional view of the footbed mating with the midsole constructed in accordance with the teachings of the present invention.

FIG. 2 illustrates a cross-sectional view of the footbed 114 from FIG. 1 mating with the midsole 104 from FIG. 1. Specifically, FIG. 2 shows a cross-sectional view of the hind foot region of footbed 114 mating with the hind foot region of midsole 104, exposing a cross-section of second air cavity 108. FIG. 2 also shows a dual-density configuration of the footbed 114, which includes density 202 and density 204.

In one embodiment, density 202 fills the top face perimeter and side face perimeters of footbed 114 as shown in FIG. 2, and in some embodiments, comprises a durometer of 65. Density 204 fills the inside of footbed 114 and the majority of the bottom face perimeter of footbed 114 as shown in FIG. 2, and in some embodiments, comprises a durometer of 35. The dual density of the footbed 114 allows for a greater flexibility and cushioning in the forefoot and heel regions due to its lighter density and provides greater support and stability around the perimeter area of the footbed 114 due to its heavier density.

In some embodiments, density 202 fills the side face perimeters of footbed 114 around the entire footbed 114. For example, density 202 may fill the side perimeter area around the outside surface of footbed 114. Density 204 fills the inside of footbed 114, including the majority of the top face perimeter and bottom face perimeter.

In some embodiments, densities 202, 204 may have durometer that range +−20. For example, density 202 may have a durometer in a range of 45-85. As another example, density 204 may have a durometer of 15-55.

By combining the specific material and densities of the footbed 114 with the specific material and densities of the midsole 104, the air cavities, such as second air cavity 108 as shown in FIG. 2, act as suspension units under the impact areas of a foot, providing improved impact reduction and help in reducing muscular and joint stress, fatigue, and impact during the normal walking gait motion. For example, as shown in FIG. 2, when pressure is applied to the hindfoot region of footbed 114, the hindfoot region of footbed 114 is suspended by second air cavity 108 of midsole 104, effectively providing improved impact reduction.

Figure 3:
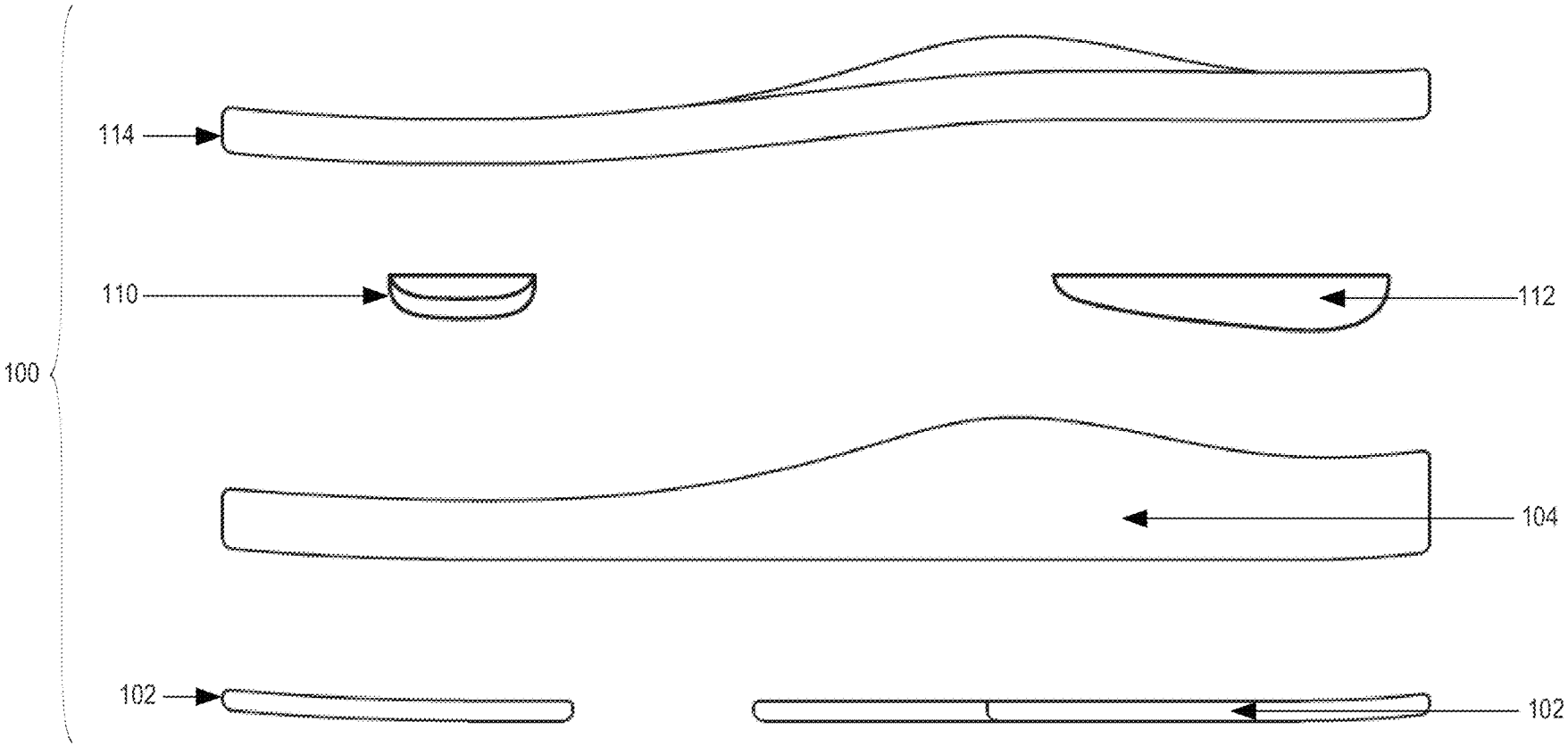
FIG. 3 illustrates a side view of an article of footwear as shown in FIG. 1

FIG. 3 illustrates a side view of the article of footwear 100 shown in FIG. 1. For example, FIG. 3 includes the outsole 102, midsole 104, Poron® cellular urethane foam insert 110 that rests in first air cavity 106 from FIG. 1, Poron® cellular urethane foam insert 112 that rests in the second air cavity 108 from FIG. 1, and footbed 114.

What is claimed is:

1. A midsole layer for an article of footwear, the midsole layer comprising a forefoot region and a hindfoot region, the forefoot region including an air cavity on a proximal face of the midsole layer, wherein:

the midsole layer has a longitudinal bisecting axis that divides the midsole layer into a medial half portion and a lateral half portion, the air cavity has a substantially uniform first depth in a first portion and a substantially uniform second depth in a second portion that is less than the first depth, the air cavity is entirely defined by the first and second portions of the air cavity, the first portion of the air cavity is entirely disposed within the medial half portion of the midsole layer, the second portion of the air cavity is present both in the medial half portion of the midsole layer and in the lateral half portion of the midsole layer, such that the second portion of the air cavity spans across the longitudinal bisecting axis of the midsole layer, and the air cavity is filled with a cellular urethane foam insert.

2. The midsole layer according to claim 1, wherein:

the cellular urethane foam insert has a substantially uniform first thickness in a first portion of the cellular urethane foam insert and a substantially uniform second thickness in a second portion of the cellular urethane foam insert that is less than the first thickness, the cellular urethane foam insert is entirely defined by the first and second portions of the cellular urethane foam insert, the first portion of the cellular urethane foam insert is entirely disposed within the medial half portion of the midsole layer, the second portion of the cellular urethane foam insert is present both in the medial half portion of the midsole layer and in the lateral half portion of the midsole layer, such that the second portion of the cellular urethane foam insert spans across the longitudinal bisecting axis of the midsole layer, and the first portion of the cellular urethane foam insert rests in the first portion of the air cavity and the second portion of the cellular urethane foam insert rests in the second portion of the air cavity.

3. The midsole layer according to claim 1, wherein the midsole layer is made of ethyl-vinyl-acetate (EVA) with a hardness being a durometer of 65.

4. The midsole layer according to claim 1, wherein the hindfoot region includes a second air cavity on the proximal face of the midsole layer, and the second air cavity is filled with a cellular urethane foam insert.

5. An article of footwear, comprising:

(a) a footbed layer;

(b) a midsole layer having a forefoot region and a hindfoot region, the forefoot region including an air cavity on a proximal face of the midsole layer, the proximal face of the midsole layer being attached to the footbed layer, wherein:

the midsole layer has a longitudinal bisecting axis that divides the midsole layer into a medial half portion and a lateral half portion, the air cavity has a substantially uniform first depth in a first portion and a substantially uniform second depth in a second portion that is less than the first depth, the air cavity is entirely defined by the first and second portions of the air cavity, the first portion of the air cavity is entirely disposed within the medial half portion of the midsole layer, the second portion of the air cavity is present both in the medial half portion of the midsole layer and in the lateral half portion of the midsole layer, such that the second portion of the air cavity spans across the longitudinal bisecting axis of the midsole layer, and the air cavity is filled with a cellular urethane foam insert; and (c) an outsole layer that is attached to a distal face of the midsole layer.

6. The article of footwear according to claim 5, wherein the proximal face of the midsole layer is attached to the footbed layer through cementing or adhesives.

7. The article of footwear according to claim 6, wherein the footbed layer has a first material with a first hardness and a second material with a second hardness that is less than the first hardness and wherein the first material comprises EVA with the first hardness being a durometer of 65.

8. The article of footwear according to claim 6, wherein the footbed layer has a first material with a first hardness and a second material with a second hardness that is less than the first hardness and wherein the second material comprises EVA with the second hardness being a durometer of 35.

9. The article of footwear according to claim 6, wherein the footbed layer has a first material with a first hardness and a second material with a second hardness that is less than the first hardness and wherein the first material fills a top face perimeter and a side face perimeter of the footbed layer, and wherein the second material fills an inside of the footbed layer and a majority of a bottom face perimeter of the footbed layer.

10. The article of footwear according to claim 6, wherein the footbed layer has a first material with a first hardness and a second material with a second hardness that is less than the first hardness and wherein the first hardness has a durometer of 45-85.

11. The article of footwear according to claim 6, wherein the footbed layer has a first material with a first hardness and a second material with a second hardness that is less than the first hardness and wherein the second hardness has a durometer of 15-55.

12. The article of footwear according to claim 5, wherein an exterior face of the outsole layer is configured to engage with a walking surface.

13. An article of footwear, comprising:

(a) a footbed layer;

(b) a midsole layer having a forefoot region and a hindfoot region, the forefoot region including an air cavity on a proximal face of the midsole layer, the proximal face of the midsole layer being attached to the footbed layer, wherein:

the midsole layer has a longitudinal bisecting axis that divides the midsole layer into a medial half portion and a lateral half portion, the air cavity has a substantially uniform first depth in a first portion and a substantially uniform second depth in a second portion that is less than the first depth, the air cavity is entirely defined by the first and second portions of the air cavity, the first portion of the air cavity is entirely disposed within the medial half portion of the midsole layer, the second portion of the air cavity is present both in the medial half portion of the midsole layer and in the lateral half portion of the midsole layer, such that the second portion of the air cavity spans across the longitudinal bisecting axis of the midsole layer, and the air cavity is filled with a cellular urethane foam insert; and (c) an outsole layer that is attached to a distal face of the midsole layer, wherein:

the outsole layer comprises a forefoot piece and a hindfoot piece, the hindfoot piece includes a first extension on a first side of the hindfoot piece extending forward toward the forefoot piece and a second extension on a second side of the hindfoot piece extending forward toward the forefoot piece, and the first extension extends farther forward than the second extension.

14. The article of footwear according to claim 13, wherein:

the cellular urethane foam insert has a substantially uniform first thickness in a first portion of the cellular urethane foam insert and a substantially uniform second thickness in a second portion of the cellular urethane foam insert that is less than the first thickness, the cellular urethane foam insert is entirely defined by the first and second portions of the cellular urethane foam insert, the first portion of the cellular urethane foam insert is entirely disposed within the medial half portion of the midsole layer, the second portion of the cellular urethane foam insert is present both in the medial half portion of the midsole layer and in the lateral half portion of the midsole layer, such that the second portion of the cellular urethane foam insert spans across the longitudinal bisecting axis of the midsole layer, and the first portion of the cellular urethane foam insert rests in the first portion of the air cavity and the second portion of the cellular urethane foam insert rests in the second portion of the air cavity.

15. The article of footwear according to claim 13, wherein the hindfoot piece and the forefoot piece are separate and spaced apart from one another.

16. The article of footwear according to claim 13, wherein the footbed layer has a first material with a first hardness and a second material with a second hardness that is less than the first hardness.

17. The article of footwear according to claim 16, wherein the first hardness has a durometer of 45-85.

18. The article of footwear according to claim 16, wherein the second hardness has a durometer of 15-55.

19. The article of footwear according to claim 13, wherein the hindfoot region includes a second air cavity on the proximal face of the midsole layer, and the second air cavity is filled with a second cellular urethane foam insert.

20. The article of footwear according to claim 13, wherein an exterior face of the outsole layer is configured to engage with a walking surface.

* * * * *